United States Patent [19]

Muntz et al.

[11] 3,953,618

[45] Apr. 27, 1976

[54] ELECTROSTATIC IMAGE DEVELOPING PROCESS

[75] Inventors: Eric P. Muntz, Pasadena; Murray S. Welkowsky, Los Angeles, both of Calif.

[73] Assignee: Xonics, Inc., Van Nuys, Calif.

[22] Filed: Sept. 20, 1974

[21] Appl. No.: 507,677

Related U.S. Application Data

[62] Division of Ser. No. 356,502, May 2, 1973, Pat. No. 3,861,354.

[52] U.S. Cl. ..... 427/21; 427/27

[51] Int. Cl.[2] ..... G03G 13/00

[58] Field of Search ..... 427/21; 118/629, 637, 118/DIG. 5

[56] References Cited

UNITED STATES PATENTS

| | | | |
|---|---|---|---|
| 2,861,543 | 11/1958 | Crumrine et al. | 427/21 |
| 2,914,221 | 11/1959 | Rosenthal | 222/146 |
| 3,251,685 | 5/1966 | Bickmore | 96/1 |
| 3,357,399 | 12/1967 | Fisher | 118/637 |
| 3,357,403 | 12/1967 | Donalies | 427/21 |
| 3,372,675 | 3/1968 | Tressel | 427/21 |
| 3,460,468 | 8/1969 | Johnson | 101/40 |
| 3,613,637 | 10/1971 | Shah et al. | 427/21 |
| 3,640,246 | 2/1972 | Jeromin et al. | 118/629 |
| 3,861,354 | 1/1975 | Muntz et al. | 118/629 |

*Primary Examiner*—Ronald H. Smith
*Assistant Examiner*—Stuart D. Frenkel
*Attorney, Agent, or Firm*—Harris, Kern, Wallen & Tinsley

[57] ABSTRACT

An electrostatic image developer of the powder cloud type incorporating an image field screen or plate adjacent the receptor sheet carrying the electrostatic image, and including means for varying the image field plate potential and spacing during the developing cycle for improved contrast in the resultant visual picture. A method of developing including varying the image field screen potential and spacing during the developing cycle.

3 Claims, 2 Drawing Figures

ELECTROSTATIC IMAGE DEVELOPING PROCESS

Figure 1:
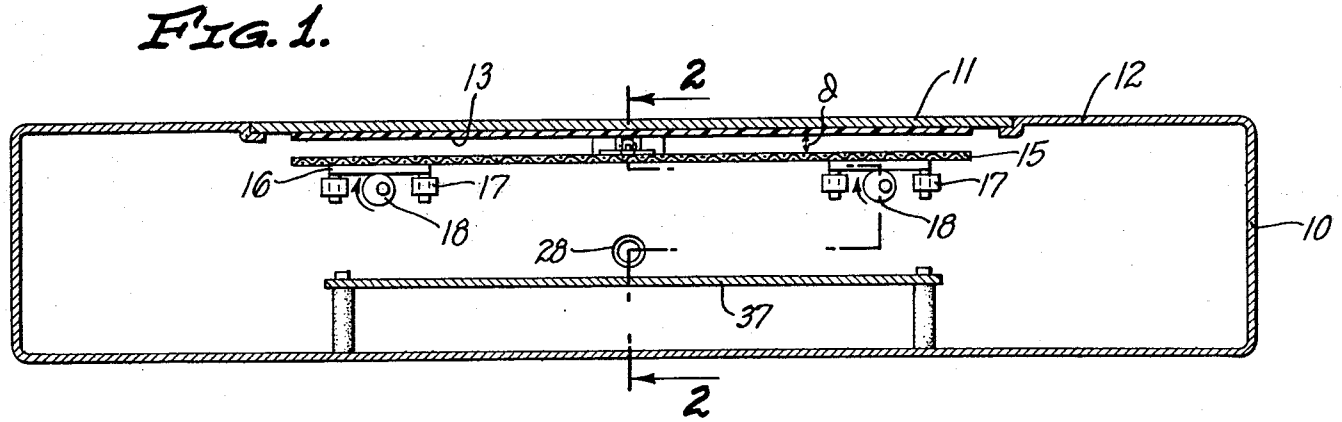

This is a division of application Ser. No. 356,502, filed May 2, 1973, now U.S. Pat. No. 3,861,354.

This invention relates to developing of electrostatic images such as occurs in xerography and ionography. In a typical system, an electrostatic image of varying charge potential is produced on a receptor sheet, such as a sheet of selenium or a sheet of a plastic dielectric. Toner particles are deposited on the receptor sheet, with the toner particle density being a function of the electrostatic charge on the receptor. The toner is fixed in place, as by heating. Conventional developing chambers are described in U.S. Pat. Nos. 3,646,910 and 3,648,901 and in the art cited therein.

An improved form of developing chamber and method of developing is disclosed in copending application Ser. No. 283,311 filed Aug. 24, 1972 entitled Electron Radiogram Developer with Image Field Screen, now U.S. Pat. No. 3,842,806 and assigned to the same assignee as the present application.

This copending application discloses the use of an apertured electrode plate or screen, sometimes referred to as an image field screen, positioned adjacent the receptor sheet carrying the electrostatic image, with the screen at a potential related to that of the background potential of the receptor sheet so that charged toner particles are attracted through the screen to the receptor only at localities having a charge above that of the background. In the development of any electrostatic image, image quality is deteriorated whenever toner is deposited without regard to the charge present on the image carrying receptor. This background toner decreases the contrast of the resultant visual image. Where there is a background charge throughout a receptor sheet, such as is produced by scattered radiation in an X-ray system, visual image contrast is improved by depositing toner particles only where the local charges are greater than the generally uniform background charge. The image field screen of the aforesaid copending application provides this function, with a marked improvement in contrast.

The U.S. Pat. to Walkup, No. 2,784,109, shows a developer for an electrostatic latent image incorporating a development control electrode in the form of an array of fine wire conductors spaced from the image carrying plate and having a variable control potential connected thereto for improving image perceptibility under certain conditions. However, the Walkup device does not permit rapid development of low charge density images and problems are encountered in obtaining improved contrast in high density areas.

It has now been found that improved visual images can be obtained in developers incorporating the image field screen by varying the potential on the screen during the developing cycle and by varying the distance between the screen and the receptor during the developing cycle. This new process provides an improved visual image with enhanced contrast, particularly at higher densities, and permits control of the contrast at different densities in the picture depending upon the characteristics of the object being X-rayed and upon the information the radiologist is seeking.

Accordingly, it is an object of the invention to provide a new and improved electrostatic developer and method of developing incorporating an image field screen with means for varying the potential and varying the distance with respect to the receptor sheet during the developing cycle. Other objects, features and results will more fully appear in the course of the following description.

Figure 2:
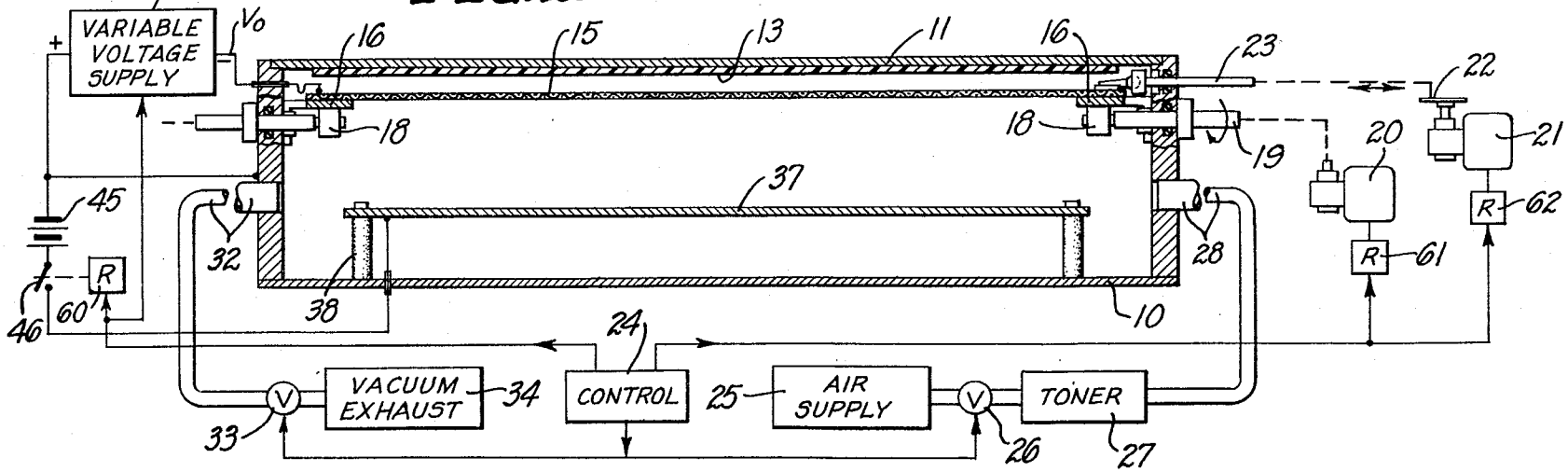

In the drawing:

FIG. 1 is a vertical sectional view through a powder cloud developer incorporating the presently preferred embodiment of the invention; and FIG. 2 is a vertical sectional view taken along the line 2—2 of FIG. 1.

The apparatus includes a chamber or housing 10, with a backing electrode 11 positioned at an opening in the top 12 of the chamber. A receptor sheet or plate 13 having the electrostatic charge image thereon is carried on the backing electrode 11. The receptor sheet may be a conventional element such as a plastic sheet or a selenium sheet with the electrostatic image produced by conventional techniques such as xerography or ionography.

An apertured plate, preferably a wire screen 15, is carried in the chamber 10 adjacent the receptor sheet, as by means of angles 16 which slide vertically in brackets 17 affixed to the wall of the chamber. The screen 15 is positioned generally parallel to the receptor sheet 13, with the spacing d between sheet and screen being determined primarily by the potential of the charge on the receptor sheet. Typically the spacing is in the range of a quarter millimeter to ten millimeters, and with the low charge densities usually obtained in ionography, the spacing is in the order of a few millimeters.

Means are provided for varying the distance d between the screen 15 and receptor 13 and typically this may be accomplished by moving the screen, with various conventional mechanisms, such as lead screws, levers, cams and the like. The embodiment illustrated incorporates cams 18 which engage the angles 16, with the cams carried on shafts 19 rotated by a motor 20.

Means are provided for moving the screen 15 relative to the image on the sheet 13 in a reciprocating or oscillating manner so that an image of the screen itself is not formed on the finished picture. The motion of the screen relative to the sheet desirably should be uniform and llnear during the developing cycle. A motor 21 may be coupled to the screen 15 via crank 22 and arm 23. The motors 20 and 21 are illustrated outside the chamber 10 in FIG. 2, but may be positioned within the chamber if desired.

A cloud of charged toner powder particles is produced within the chamber at the start of the developing cycle by conventional means, such as the toner injection mechanism illustrated in FIG. 2 comprising control unit 24, air supply 25, valve 26, toner supply 27 and nozzle 28. At the end of the developing cycle excess toner may be moved from the chamber by conventional means such as nozzle 32, valve 33 and vacumn exhaust unit 34.

A charge selection electrode 37 is mounted in the chamber 10 and electrically insulated from the chamber by standoff insulators 38.

The chamber 10 may be of metal and serve as circuit ground, with the backing electrode 11 forming a portion of the chamber and being at circuit ground. An electric field is produced within the chamber by connecting an electric power source 45 through switch 46 between the chamber and the charge selection electrode 37. A biasing potential Vo is provided for the screen 15 by a variable voltage supply 52 connected between the chamber and the screen, with the screen insulated from the chamber as by forming the angles 16 and drive rod 23 of electrical insulating material. The polarities for the voltages are dependent on the polarity of the charge on the receptor sheet. In the example illustrated, the electrostatic charges on the receptor sheet are negative and the electrode 37 is made positive with respect to the chamber and the backing electrode 11. The voltage on the screen 15 is negative with respect to circuit ground. For a receptor sheet having positive electrostatic charges, all of the supply voltages would be reversed from that shown in FIG. 2.

At the start of a developing cycle, the cams 18 are at a predetermined position to provide a predetermined value for *d*, for example, with *d* at a minimum value such as 1 millimeter, and the variable voltage supply 52 is set to provide a predetermined value for Vo, such as maximum of approximately 200 volts. A charged receptor sheet is placed in position as illustrated, with the charged side down. A cloud of toner particles is introduced into the chamber through the nozzle 28. The control unit 24 opens the valve 26 for a short period of time providing a pressurized burst of air to the toner unit 27 which provides the cloud of charged toner particles in the chamber, with some particles charged positive and some particles charged negative. The control unit 24 also energizes relay 60 to close switches 46 and 49, and energizes the variable voltage supply 52 to provide the output Vo. The control unit also actuates relays 61 and 62 to energize motors 20 and 21, respectively. The negative charges on the receptor sheet will attract only the positive charged toner particles and the negative charged toner particles are attracted to the charge selection electrode 37. In a typical chamber, the source 45 may be selected to provide a field in the order of 500–2000 volts per centimeter.

First consider operation with the screen 15 at circuit ground potential. At localities where charges exist on the receptor sheet 13, a corresponding electric field is established between the receptor and screen and toner particles are attracted through the screen to the receptor surface, in proportion to the strength of the field. Where no charge exists on the receptor, there is no field between receptor and screen and no force attracting toner particles to the receptor. Under these conditions, there is substantially no toner deposited on the receptor in zero charge background areas.

However, in actual practice many electrostatically charged receptor sheets have a generally uniformly distributed background charge such as that resulting from scattered radiation in X-ray radiography. When a receptor sheet with a background charge is developed with the screen 15 at circuit ground potential, the toner will be deposited over the entire sheet resulting in a reduction in contrast of the visual image.

The visibility of the scattered radiation in the finished visual image is substantially reduced by providing a bias potential on the screen 15 with respect to the receptor 13, as described in the aforesaid copending application. With a bias potential on the screen 15, charged toner particles are attracted through the screen to the receptor only at localities carrying a charge greater than a particular value.

The present invention provides for continuously varying the potential Vo of the screen 15 as a function of time during the developing cycle, which typically is in the order of 60 seconds. The present invention also provides for varying the distance *d* between the screen 15 and receptor 13 continuously as a function of time during the developing cycle while varying the screen potential. By appropriately choosing the maximum and minimum distance and maximum and minimum potential and the characteristic of the rate of change, i.e., linear, logarmithic and the like, the radiologist is provided with a control of the contrast for various charge magnitudes and image densities.

In one mode of operation, the developing cycle is initiated with $(V_{max}-Vo_{max})/d_{min}$ set to be sufficiently large to attract the toner. V is the potential of the electrostatic charge on the receptor. The spacing *d* may be at a minimum such as about 1 millimeter, and the potential Vo adjusted such that $(V_{max}-Vo_{max})$ is large enough to attract the toner, typically about 100 volts. During the developing cycle, Vo is decreased from $Vo_{max}$ to $Vo_{min}$ and *d* is increased from $d_{min}$ to $d_{max}$, with the values selected so that $(V_{min}-Vo_{min})/d_{max}$ is about equal to $(V_{max}-Vo_{max})/d_{min}$.

At the end of the developing cycle, the power supplies and motors are turned off and the chamber is evacuated by opening valve 33, after which the receptor sheet may be removed for fixing of the toner by conventional means.

In the operation of the developer, one can start from a large spacing and a low voltage, and change to a smaller spacing and a higher voltage during the developing cycle. Alternatively, one can start from a small spacing and a high voltage, and change to a larger spacing and a lower voltage during the developing cycle. The changes can be continuous or incremental during the developing cycle.

The gamma of a given development system determines the amount of contrast for a developed image as a function of the relative amount of incident exposure. The nature of electrostatic developers is such that the optical density tends toward saturation at high relative exposures; hence, the contrast decreases.

In an electron radiogram, features of interest to a radiologist may appear at any optical density or exposure contrast level. In particular, these features may appear in areas where the normal gamma of the developer is not optimum. By using the variable voltage and spacing technique, one can generate an arbitrarily high contrast level so that the features of interest are more readily discernible.

In actual practice, one can choose a variation of voltage and spacing that will produce a relatively high level of contrast over the entire exposure range of the radiogram. For particular types of radiological examinations, a more specific (complex) variation would yield high contrast over a given range, and low contrast over other ranges of exposure, resulting in a "highlighted" radiogram only in the area of interest.

It is important to understand that this effect is achieved by varying both the screen potential and the distance at the same time. The purpose of this is to keep from saturating the development process at the lower screen potentials. A plot of density versus image field strength shows that at high field strengths the development process saturates (no contrast).

The high density obtained in a given time is at high fields, but not too high, as one then loses contrast. Thus, when the screen potential is high, the screen is moved close to maintain about 50 – 150 V/mm. As the development proceeds and the screen potential is decreased, the screen moves further away so as to maintain around 50 – 150 V/mm in the important image areas.

We claim:

1. A process for developing an electrostatic image on a receptor sheet, including the steps of:

producing a cloud of positive and negative charged toner powder particles;

attracting said toner particles of one polarity to a first electrode remote from the receptor sheet and said toner particles of the opposite polarity to a second apertured electrode positioned adjacent the side of the receptor sheet bearing the electrostatic image and between the receptor sheet and the first electrode by applying an electric potential across the first and second electrodes;

attracting the toner particles of said opposite polarity through the second apertured electrode to deposit the toner particles onto the electrostatic image on the receptor sheet at localities having a charge potential with respect to the potential of the second electrode;

varying the potential of the second electrode as a function of time during the deposition of the toner particles; and varying the distance between the second electrode and the receptor sheet as a function of time during the deposition of the toner particles.

2. The process of claim 1 wherein the potential of the second electrode is changed from a first predetermined value to a second predetermined value during the deposition of the toner particles, and the distance between the second electrode and the receptor sheet is changed from a first predetermined value to a second predetermined value during the deposition of the toner particles.

3. The process of claim 1 wherein the ratio $(V_{max} - V_{Omax})/d_{min}$ at the start of deposition of the toner particles is about equal to the ratio $(V_{min} - V_{Omin})/d_{max}$ at the end of the deposition of the toner particles, where V is the potential of the charge on the receptor sheet, Vo is the potential of the second electrode, and $d$ is the distance between the receptor sheet and second electrode.

* * * * *